US008572852B1

(12) United States Patent
Jennings et al.

(10) Patent No.: US 8,572,852 B1
(45) Date of Patent: Nov. 5, 2013

(54) SAFETY CUTTING DEVICE

(75) Inventors: Dale E. Jennings, Huntington Beach, CA (US); Dustan J. Baker, Ladera Ranch, CA (US)

(73) Assignee: Dale E. Jennings, Huntington Beach, CA (US)

( * ) Notice: Subject to any disclaimer, the term of this patent is extended or adjusted under 35 U.S.C. 154(b) by 179 days.

(21) Appl. No.: 13/301,548

(22) Filed: Nov. 21, 2011

Related U.S. Application Data

(60) Provisional application No. 61/416,853, filed on Nov. 24, 2010.

(51) Int. Cl.
*B26B 3/06* (2006.01)
*B26B 29/00* (2006.01)

(52) U.S. Cl.
USPC ..... 30/162; 30/295

(58) Field of Classification Search
USPC ..... 30/162, 151, 159, 160, 286, 295, 314, 30/317, 293, 289, 288, 2, 154, 161; 83/221, 366, 399, 400
See application file for complete search history.

(56) References Cited

U.S. PATENT DOCUMENTS

| | | | | |
|---|---|---|---|---|
| 2,632,949 | A * | 3/1953 | Falcone | 30/162 |
| 4,091,537 | A | 5/1978 | Stevenson, Jr. | |
| 5,890,290 | A * | 4/1999 | Davis | 30/2 |
| 6,070,326 | A | 6/2000 | Berns | |
| 6,233,832 | B1 | 5/2001 | Berns | |
| 6,446,340 | B1 * | 9/2002 | Ping | 30/125 |
| 6,453,559 | B1 | 9/2002 | Marshall et al. | |
| 6,484,404 | B1 * | 11/2002 | Kao | 30/162 |
| 6,560,873 | B1 | 5/2003 | Ortner et al. | |
| 6,637,112 | B2 | 10/2003 | Davis | |
| 6,718,637 | B1 | 4/2004 | Ortner et al. | |
| 6,718,640 | B1 | 4/2004 | John | |
| 7,024,772 | B1 | 4/2006 | Shaver et al. | |
| 7,024,773 | B2 * | 4/2006 | Jennings | 30/2 |
| 7,082,688 | B2 | 8/2006 | Votolato | |
| 7,305,770 | B2 | 12/2007 | Critelli et al. | |
| 7,356,928 | B2 | 4/2008 | Votolato | |
| 7,774,942 | B2 * | 8/2010 | Schmidt | 30/162 |
| 2005/0193568 | A1 * | 9/2005 | Peyrot et al. | 30/162 |
| 2008/0189956 | A1 * | 8/2008 | Polei | 30/162 |
| 2009/0151168 | A1 * | 6/2009 | Dadam | 30/146 |
| 2009/0266210 | A1 * | 10/2009 | Chung et al. | 83/144 |

* cited by examiner

*Primary Examiner* — Sean Michalski
*Assistant Examiner* — Jonathan G Riley
(74) *Attorney, Agent, or Firm* — Mind Law Firm, P.C.; Justin G. Sanders; Jeromye V. Sartain

(57) ABSTRACT

A safety cutting device comprises, in an exemplary embodiment, a housing, a longitudinally movable blade positioned within the housing, and a longitudinally movable guard positioned substantially adjacent the blade. Additionally, the device provides a means for substantially preventing the blade from extending through a first end of the housing when the guard is in a retracted position, such that the blade is incapable of extending out of the housing without first extending the guard. In further embodiments, the device provides a pair of longitudinally movable guards flanking the blade and configured for selectively moving independent of one another, thereby allowing both right- and left-handed users to operate the device without having to change any settings or reconfigure the orientation of the guards or blade. In such further embodiments, the blade is substantially prevented from extending without at least one of the guards first being moved out of the retracted position.

19 Claims, 6 Drawing Sheets

SAFETY CUTTING DEVICE

RELATED APPLICATIONS

This application claims priority and is entitled to the filing date of U.S. Provisional application Ser. No. 61/416,853, filed Nov. 24, 2010 and entitled "Safety Cutting Device." The contents of the aforementioned application are incorporated by reference herein.

INCORPORATION BY REFERENCE

Applicants hereby incorporate herein by reference any and all U.S. patents and U.S. patent applications cited or referred to in this application.

BACKGROUND

1. Field of the Invention

Aspects of this invention relate generally to cutting devices, and more particularly to a safety cutting device configured for strategically shielding a blade of the device so as to prevent or substantially reduce the risk of accidental injury to a user of the device.

2. Description of Related Art

The following art defines the present state of this field:

U.S. Pat. No. 4,091,537 to Stevenson, Jr. is generally directed to a hand-held safety utility knife having an elongated shaped handle within which a replaceable cutting blade is securely retained, wherein the knife assembly is also provided with a compression-extension spiral spring loaded retractable blade guard that is mechanically cooperative with the cutting blade of the knife and manually activated for retraction by depressing a compression-extension spiral spring loaded trigger thereby enabling cutting utility of the blade in use application, and upon manual trigger release after use application provides non-use safety locking of the guard with respect to the utility knife cutting blade.

U.S. Pat. No. 5,890,290 to Davis is generally directed to an improved carton cutter having an incrementally extendable fully retractable first cutting blade with a depressible safety guard at its front end. A strap cutting second blade is fixed at a hooked rear end of the cutter. A ratchet mechanism provides audible evidence of the amount of blade extension and a pointer shows the position of the front blade. The front blade is mounted on a lockable slide. Both blades are easily removable without disassembly and precisely positioned without noticeable play.

U.S. Pat. No. 6,070,326 to Berns is generally directed to a knife comprising an elongated handle having an outer end and a longitudinally extending flat blade secured in the handle and projecting from the outer end. The blade has a transverse outer edge and a longitudinally extending side cutting edge meeting at a point. The handle is formed with a pair of longitudinally outwardly open and longitudinally extending guides flanking the blade adjacent the cutting edge thereof. Respective longitudinally extending pins having generally parallel and transversely projecting outer ends sections are longitudinally displaceable in the guides between extended positions with the outer end sections lying longitudinally outward of the point and retracted positions with the outer end sections longitudinally rearward of the point and the blade passing between the outer end sections. Respective springs braced between the pins and the handle urge the pins into the extended positions.

U.S. Pat. No. 6,233,832 to Berns is generally directed to a knife comprising an elongated handle having a front end, a longitudinally extending flat blade secured in the handle, projecting from the front end, and having a transverse front edge and a longitudinally extending side cutting edge meeting at a point, and a blade guard longitudinally displaceable on the handle between an outer extended position projecting longitudinally outward of the point and a retracted position exposing the point. A guard spring braced between the guard and the handle urges the guard into the extended position. A button is transversely displaceable on the handle between an actuated and an unactuated position and interengageable formations on the button and on the guard prevent movement of the guard from the extended into the retracted position in the unactuated position of the button.

U.S. Pat. No. 6,453,559 to Marshall et al. is generally directed to a safety knife comprising a handle and a blade mounted on the handle so that a part of the blade projects from the handle. Two retractable safety guards are also mounted on the handle, overlying opposite sides of the projecting portion of the blade. Each guard is spring-loaded so that pressure from the material being cut causes the guards to retract into the handle as the blade cuts into the material. A manually controlled locking device normally prevents the guards being retracted but, when operated, allows the guards to retract. The guards automatically extend, under the action of springs, when the knife is removed from the material.

U.S. Pat. Nos. 6,560,873 and 6,718,637 to Ortner et al. are generally directed to an automatic safety knife having a safety hood which is pivotally mounted to the body of the knife at the front end. The body is pivotally mounted to a spine at the back end. The blade is removably mounted on the spine such that the hood covers the blade when the knife is closed. The hood is biased closed and has a latch to hold it closed unless the latch is released. The user depresses a button, which moves the latch, releasing the hood to push up when the user presses the hood against a working surface. The upward rotation of the hood releases the latch, so that when the hood rotates down the latch automatically re-locks the hood closed. The hood cannot be release again with out releasing the button and re-depressing the button. The hood's rotation, and therefore the about of blade exposed, is controlled by an adjustable depth assembly. The adjustable depth assembly has multiple settings, allowing the user to control the cutting depth of the knife.

U.S. Pat. No. 6,637,112 to Davis is generally directed to a deflectable safety shield extending transversely across a cutting plane in a protective guard position completely overlying the cutting edge of a utility knife. A portion of the shield extends over-center with respect to the cutting edge, thereby tending to hold the shield in the guard position in response to contact of the shield against the operator at the normal angle of engagement during follow-through that accompanies rapid slicing hand movements. The shield is resiliently biased for movement to the guard position by a torsion spring. An outwardly-turned flange portion of the shield provides an angularly offset leverage point for reacting the torsion spring when the operator desires to perform a cutting operation. The shield swings away from the cutting plane automatically in response to pressure engagement of the offset flange portion against the box surface, thus exposing the cutting edge.

U.S. Pat. No. 6,718,640 to John is generally directed to a cutting tool having a blade and a member which is biased toward a safety position, in which the member forms a guard for the blade, but which may be displaced for exposing the blade by bringing the tool into cutting contact with a work piece. The cutting tool includes a locking mechanism having a trigger which must be moved from a first position to a second position to release the guard member from its safety position and which is arranged, so that each time the guard member is released from its safety position, it is displaced through a predetermined distance and then returns to its safety position. The guard member will become locked in place regardless of the position of the trigger.

U.S. Pat. No. 7,024,772 to Shaver et al. is generally directed to a case knife generally consisting of a pair of substantially symmetrical handle shells. A single edge razor blade is removably supported in one end of the handle formed by these handle shells. Each handle shell includes two moving parts—a guard and a thumb or finger operable button. Each such guard, when paired with a substantially identical guard of the other handle half shell, flanks the otherwise protruding sharp edge of the razor blade. Each guard can move independently to expose a protruding corner of the razor blade. The operable button is mounted on an axle or lug that passes from the inside of a handle shell, through to its outside surface. This axle is in turn fixed to a cam follower mounted on the inside of each shell.

U.S. Pat. No. 7,024,773 to Jennings is generally directed to a safety cutter with a retracting guard. The safety cutter has a blade permanently held to the blade handle. The blade has a point which extends beyond the handle and is surrounded by a retracting guard. When enabled, the guard retracts into the handle when the guard is pressed against an object to be cut, thereby exposing the point of the blade. The safety cutter is made so that it may be operated either by a right handed person or a left handed person. A button override is also provided on each side of the handle so that the guard can be retracted by pressing only one of the buttons. Preferably, a portion of the override can be removed so that the guard can only be released by pushing the push button.

U.S. Pat. No. 7,082,688 to Votolato is generally directed to a utility knife having both left and right side cutting guides. The guides are preferably retractable, and lockable in either retracted or operating positions. The distance between the guides and the blade of the knife can be either fixed or adjustable. The knife preferably also includes a retractable hood that covers the blade.

U.S. Pat. No. 7,305,770 to Critelli et al. is generally directed to a utility knife comprising a blade carriage having a blade-receiving bay and moveable relative to the knife's housing to move a cutting blade disposed in the bay from a retracted position to a deployed position. A locking mechanism is operative to releasably couple the cutting blade to the carriage and may include a lock plate having an blade-engagement element and moveable by non-pivoting, generally vertical displacement between a locked position and an unlocked position. An actuator engages the locking mechanism and moves the locking mechanism from the locked position to the unlocked position. The actuator may directly contact an underside of a protrusion of the locking mechanism, may be moveably mounted on the sidewall to which the bay opens toward, may be prevented from being moved as far when the actuator is not aligned with the locking mechanism, or any combination thereof.

U.S. Pat. No. 7,356,928 to Votolato is generally directed to a utility knife having a protective guard that moves from a locked position to an unlocked position. Preferred mechanisms utilize a pawl that cooperates with a stop to reduce movement of the guard while the guard is in a locked position, and a simple latching mechanism that allows the pawl to bypass the stop. The pawl is disposed with respect to other elements of the mechanism such that the blade guard can only pulled back to a retracted position after operation of a trigger or other actuator, and then only for a single use. Both the stop and the catch can advantageously be carried in a fixed special relation to one another by operation of a trigger or other actuator.

U.S. Patent Application Publication No. 2009/0266210 to Chung et al. is generally directed to a cutter apparatus comprising a housing shaped to be hand-held, a slider configured to support a front blade, the slider being mechanically coupled to the housing and configured to be moved longitudinally along the housing, and a blade guard mechanically coupled to the housing and configured to be extended and retracted adjacent to the front end of the housing, wherein the slider and the blade guard are configured to move in tandem.

U.S. Pat. No. 7,774,942 to Schmidt is generally directed to a utility knife comprising a handle, a blade assembly secured to the handle, a blade cover mechanically coupled to the handle facilitating manipulability of the blade cover to an extended position over the blade assembly, and a slider that is repositionable along the handle to release the blade cover from the extended position, the slider being pivotally coupled to the blade assembly.

The prior art described above teaches various types of cutting devices, including devices having selectively extendable blades, multiple blade guards, and even selectively extendable and/or retractable blade guards. However, the known prior art fails to teach such a device that is configured for preventing the blade from being extended without first extending a blade guard. Furthermore, the known prior art fails to teach such a device that physically prevents the blade from unintentionally extending past the guard when the guard is extended. Aspects of the present invention fulfill these needs and provide further related advantages as described in the following summary.

SUMMARY

Aspects of the present invention teach certain benefits in construction and use which give rise to the exemplary advantages described below.

Aspects of the present invention are directed to solving these problems by providing a safety cutting device comprising, in an exemplary embodiment, a housing, a longitudinally movable blade positioned within the housing, and a longitudinally movable guard positioned substantially adjacent the blade. The blade is configured for selectively moving between one of an extended blade position, wherein a leading point of the blade extends through a blade aperture in a first end of the housing, and a retracted blade position, wherein the entire blade is positioned within the housing. Similarly, the guard is configured for selectively moving between one of an extended guard position, wherein a leading edge of the guard extends a distance past the first end of the housing, and a retracted guard position, wherein the leading edge is positioned relatively closer to the first end. Additionally, the device provides a means for preventing the blade from moving toward the extended blade position when the guard is in the retracted guard position, such that the blade is incapable of moving toward the extended blade position without first moving the guard toward the extended guard position. Thus, aspects of the present invention provide a solution to the above discussed shortcomings of the prior art.

A primary objective inherent in the above described apparatus and method of use is to provide advantages not taught by the prior art.

Another objective is to provide such an apparatus that is configured for preventing the blade from being extended without first extending a blade guard.

A still further objective is to provide such an apparatus that physically prevents the blade from unintentionally extending past the guard when the guard is extended.

A still further objective is to provide such an apparatus that, in at least one embodiment, allows for both right-handed and left-handed use.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of exemplary embodiments of the present invention. In such drawings.

DETAILED DESCRIPTION

The above described drawing figures illustrate aspects of the invention in at least one of its exemplary embodiments, which are further defined in detail in the following description.

Figure 1:
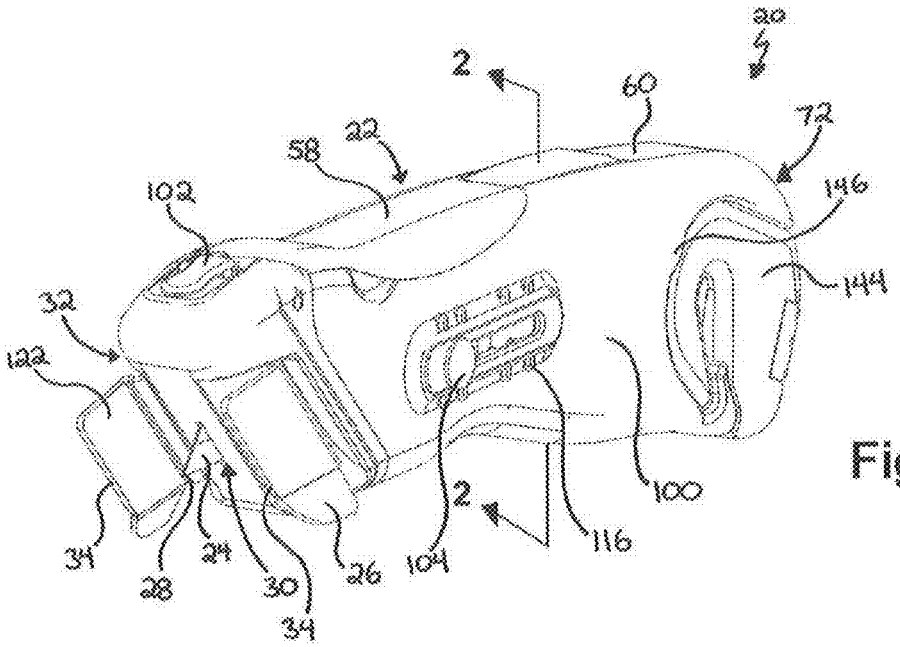
FIG. 1 is a perspective view of an exemplary embodiment of the safety cutting device.

Turning now to FIG. 1, there is shown a perspective view of an exemplary embodiment of a safety cutting device 20. The device 20 comprises, in one embodiment, a housing 22, a longitudinally movable blade 24 positioned within the housing 22, and a longitudinally movable first guard 26 positioned within the housing 22, substantially adjacent the blade 24. Preferably, the housing 22 is made of a rigid plastic; however, in further embodiments, the housing 22 may be made of any material now known or later developed, such as metal, that allows the housing 22 to substantially carry out each of the functions herein described. The blade 24 is configured for selectively moving between one of an extended blade position (FIG. 1), wherein a leading point 28 of the blade 24 extends through a blade aperture 30 in a first end 32 of the housing 22, and a retracted blade position (FIG. 2), wherein the entire blade 24 is positioned within the housing 22. Similarly, the first guard 26 is configured for selectively moving between one of an extended guard position (FIG. 3), wherein a leading edge 34 of the first guard 26 extends a distance past the first end 32 of the housing 22, and a retracted guard position (FIG. 2), wherein the leading edge 34 is positioned relatively closer to the first end 32. The first guard 26 is preferably made of metal; however, in further embodiments, the first guard 26 may be made of any material now known or later developed, such as a rigid plastic, that allows the first guard 26 to substantially carry out each of the functions herein described. Additionally, as discussed further below, the device 20 provides a means for preventing the blade 24 from moving toward the extended blade position when the first guard 26 is in the retracted guard position. In other words, the blade 24 is incapable of moving toward the extended blade position without first moving the first guard 26 toward the extended guard position.

Figure 4:
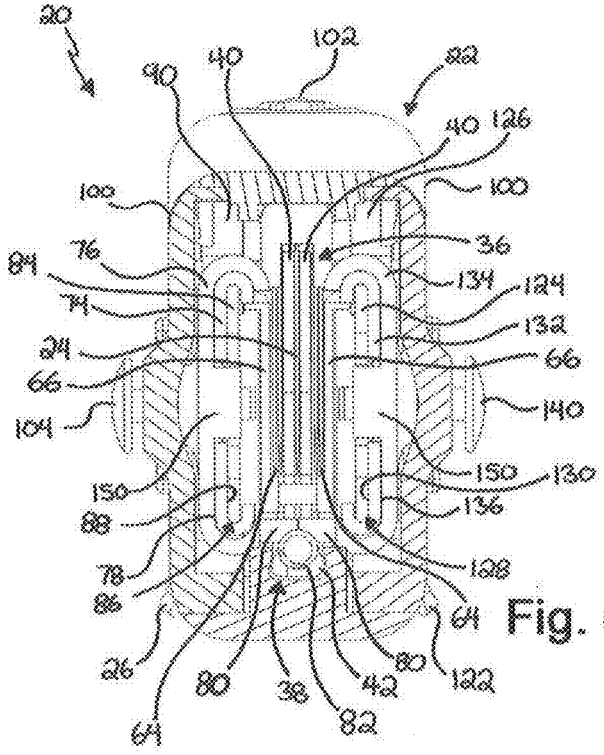
FIG. 4 is a cross-sectional view taken along line 4-4 of FIG. 2.
Figure 5:
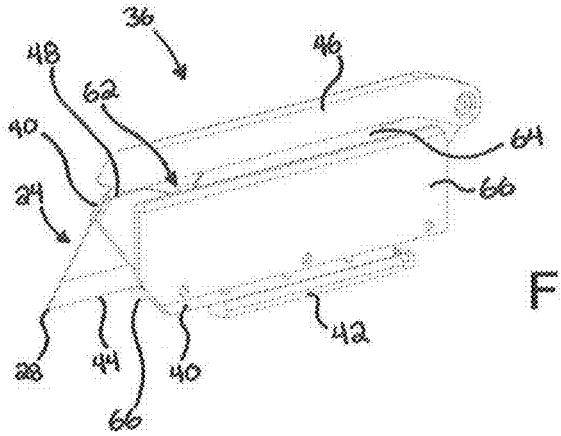
FIG. 5 is a perspective view of a blade carrier of the exemplary safety cutting device.

Referring to FIGS. 4 and 5, in the exemplary embodiment, a blade carrier 36 is slidably positioned within a longitudinally oriented blade track 38 in the housing 22 and configured for selectively receiving and moving the blade 24 between the extended blade position and retracted blade position. In the exemplary embodiment, the blade carrier 36 is further configured for allowing for top-loading of the blade 24 into the blade carrier 36. More specifically, and as shown best in FIGS. 4-6, the blade carrier 36 comprises a pair of vertically oriented carrier walls 40 spaced apart and configured for removably receiving the blade 24 therebetween. A blade support rail 42 is positioned between the carrier walls 40 and is configured for supporting a portion of a cutting edge 44 of the blade 24. Additionally, the blade support rail 42 is configured for slidable engagement within the blade track 38, thereby enabling the blade carrier 36 to selectively traverse the length of the blade track 38. A primary blade door 46 is pivotally engaged with a top edge 48 of each of the carrier walls 40 and is configured for moving between one of an open position (FIG. 6), allowing access to the blade 24, and a closed position (FIG. 5), wherein the primary blade door 46 contacts a non-cutting edge 50 of the blade 24, thereby maintaining the blade 24 within the blade carrier 36. Preferably, an inner surface 52 of the primary blade door 46 is configured for complementing a keyed surface 54 of the non-cutting edge 50 of the blade 24, so as to better maintain the position of the blade 24 during use. In the exemplary embodiment, as shown best in FIG. 6, the inner surface 52 provides an at least one laterally oriented ridge 56 positioned and configured for mating with the keyed surface 54 when the primary blade door 46 is in the closed position. It should be noted that the exact configuration of the inner surface 52 will vary depending on the particular position and dimensions of the keyed surface 54, if any, of the non-cutting edge 50 of the blade 24 to be used in connection with the cutting device 20. With continued reference to FIG. 6, a secondary blade door 58 is pivotally engaged with a top surface 60 of the housing 22 in a position substantially adjacent the primary blade door 46. The secondary blade door 58 is configured for moving between one of an open position (FIG. 6), allowing access to the primary blade door 46, and a closed position (FIG. 1), substantially obstructing access to the primary blade door 46. As shown best in FIG. 5, the top edge 48 of each of the carrier walls 40 also preferably defines a blade access notch 62 configured for exposing a portion of the non-cutting edge 50 of the blade 24 when the primary blade door 46 is in the open position, thereby allowing the blade 24 to be safely pulled out of the blade carrier 36. Thus, this top-loading feature enables a user to more safely insert and remove the blade 24 by allowing the user to grasp only the non-cutting edge 50 of the blade 24, with the cutting edge 44 directed substantially away from the user's hand at all times during insertion and removal.

Figure 6:
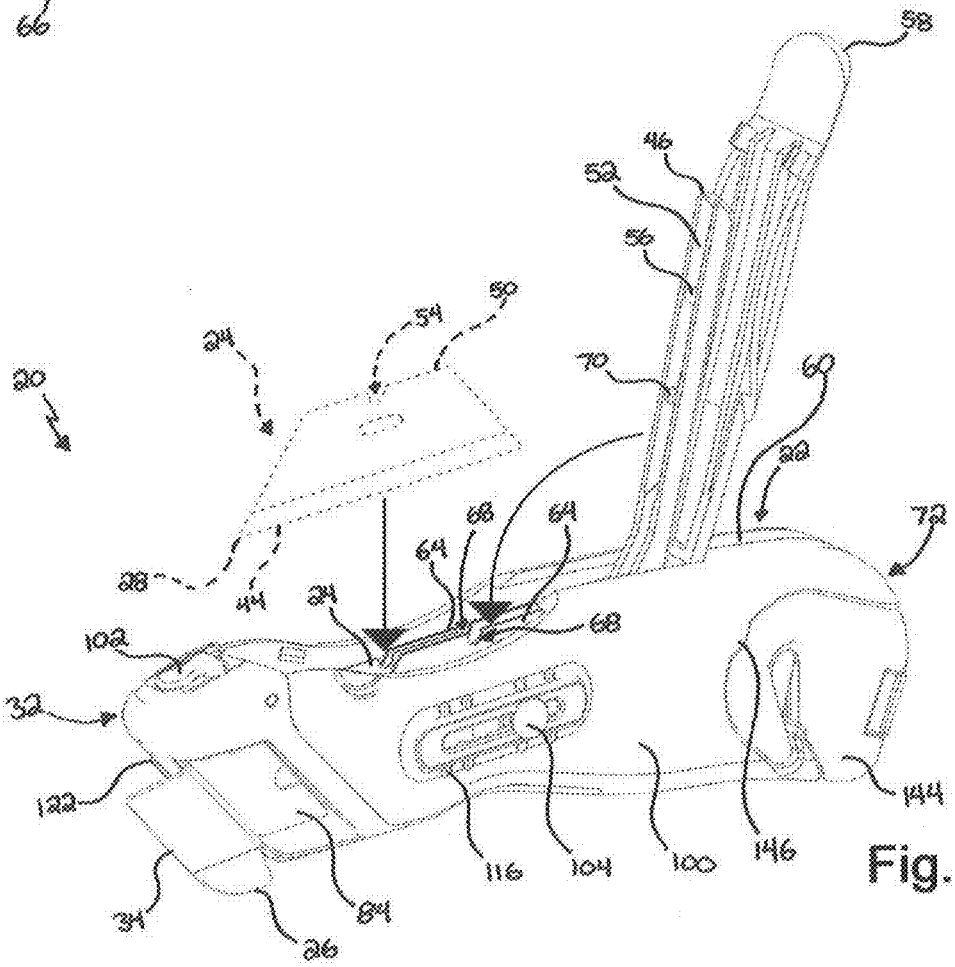
FIG. 6 is a perspective view of the exemplary safety cutting device, illustrating the exemplary method of selectively inserting a blade into the blade carrier.

With continued reference to FIGS. 4-6, in the exemplary embodiment, the blade carrier 36 is further configured for storing a plurality of replacement blades 64. More specifically, and as shown best in FIGS. 4 and 5, the blade carrier 36 comprises a pair of vertically oriented blade storage walls 66 spaced apart from and flanking the vertically oriented carrier walls 40. The space between each of the blade storage walls 66 and the respective adjacent carrier wall 40 is configured for removably receiving at least one replacement blade 64 therewithin. In the exemplary embodiment, the space between each of the blade storage walls 66 and the respective adjacent carrier wall 40 is configured for removably receiving two replacement blades 64 therewithin. As such, the blade carrier 36, in the exemplary embodiment, is capable of storing up to four replacement blades 64 total. However, again, in further embodiments, the blade storage walls 66 may be configured for storing any number of replacement blades 64. Additionally, in a still further embodiment, the blade carrier 36 may comprise only a single blade storage wall 66, adjacent one of the carrier walls 40, rather than a pair of blade storage walls 66. Similar to the blade 24, the blade carrier 36 is further configured for allowing for top-loading of the replacement blades 64 as well, thereby enabling the user to more safely insert and remove the replacement blades 64 by allowing the user to grasp only the non-cutting edge 50 of each of the replacement blades 64, with the cutting edge 44 directed substantially away from the user's hand at all times during insertion and removal. As best shown in FIG. 6, the blade carrier 36 is preferably configured for accepting and maintaining the blade 24 in a position slightly forward of the at least one replacement blade 64. This further enables the user to more easily grasp the appropriate blade 24 or 64 during insertion and removal. Additionally, in the exemplary embodiment, the inner surface 52 of the primary blade door 46 is configured for complementing a keyed surface 68 of the non-cutting edge 50 of the replacement blades 64 as well—by way of a further laterally oriented ridge 70, in the exemplary embodiment, positioned and configured for mating with the keyed surface 68—so as to better maintain the position of the replacement blades 64 within the blade carrier 36 when the primary blade door 46 is in the closed position.

In an alternate embodiment, not shown, an opposing second end 72 of the housing 22 provides a blade storage unit (not shown) configured for storing a plurality of replacement blades 64. The blade storage unit comprises a blade storage tray pivotally mounted within the housing 22 and configured for receiving the replacement blades 64; the blade storage tray being capable of pivoting in and out of an appropriately sized storage aperture in the housing 22. A blade storage door is pivotally mounted within the housing 22 and configured for moving between one of a closed position, whereby the blade storage door covers the storage aperture, and an open position, whereby a cam lifter integral with an end of the blade storage door is rotated into contact with a lower edge of the blade storage tray, thereby lifting the blade storage tray at least partially through the storage aperture, enabling access thereto. The blade storage door is preferably configured such that, when in the open position, the blade storage tray remains accessible through the storage aperture until the blade storage door is intentionally moved into the closed position. Thus, the blade storage door substantially prevents the blade storage tray from unintentionally pivoting back down into the housing 22.

Referring again to FIGS. 2-4, in the exemplary embodiment, a longitudinal first guide track 74 is positioned within the housing 22, substantially adjacent to and parallel with the blade track 38. As best shown in FIG. 4, a first blade actuating means 76 is slidably positioned on an outer surface 78 of the first guide track 74. The first blade actuating means 76 is configured for selectively contacting and moving the blade carrier 36 therewith along the adjacent blade track 38, thus selectively actuating the blade 24 between the extended blade position and retracted blade position. More specifically, in the exemplary embodiment, the first blade actuating means 76 provides an at least one actuating tab 80 configured for selectively contacting the blade carrier 36 as the first blade actuating means 76 traverses in a forward direction along the first guide track 74, thereby causing the blade 24 to move toward the extended blade position. The blade carrier 36 is preferably engaged with a blade return spring 82 positioned within the housing 22 and configured for biasing the blade carrier 36 inwardly, thereby urging the blade 24 into the retracted blade position. Thus, as the first blade actuating means 76 traverses in a reverse direction along the first guide track 74, the blade 24 automatically moves back toward the retracted blade position.

With continued reference to FIG. 4, in the exemplary embodiment, a first guard carrier 84 is slidably positioned within an inner track 86 on a inner surface 88 of the first guide track 74. The first guard carrier 84 is engaged with the first guard 26 for selectively moving the first guard 26 between the extended guard position and retracted guard position as the first guard carrier 84 traverses along the first guide track 74. In further embodiments, the first guard 26 is integral with the first guard carrier 84.

Figure 2:
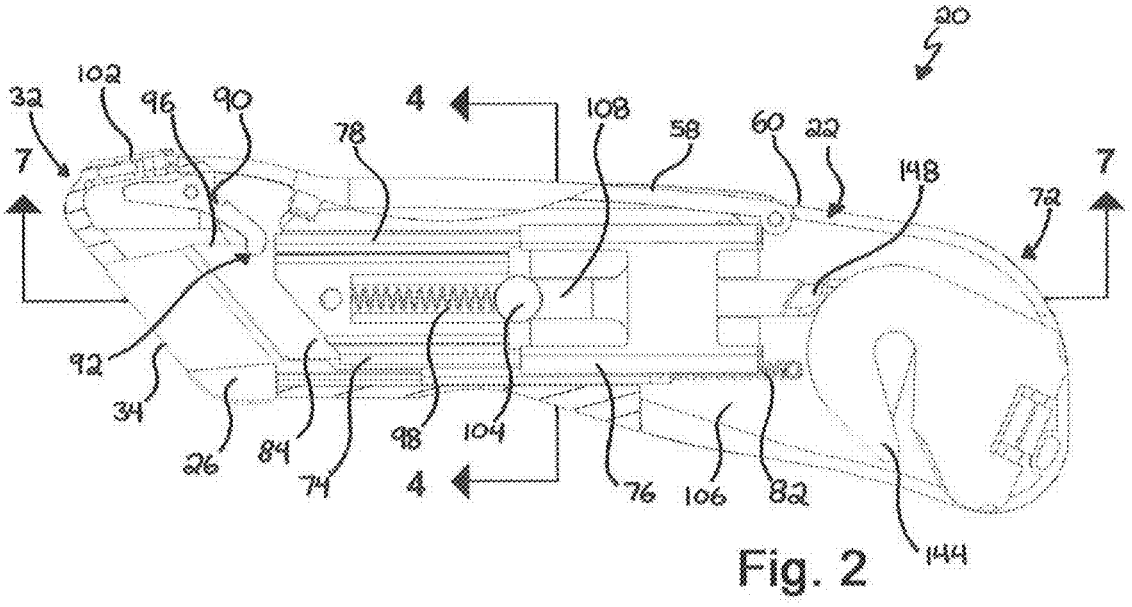
FIGS. 2 and 3 are side views thereof, with a portion of the housing of the device removed for clarity purposes.
Figure 3:
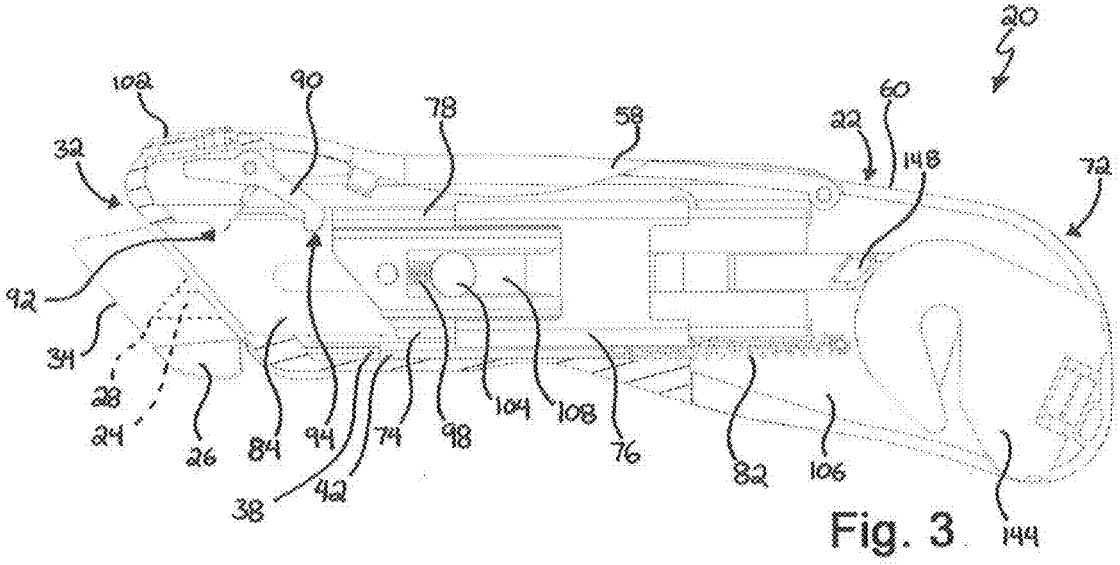

With reference to FIGS. 2 and 3, longitudinal movement of the first guard carrier 84, and thus the first guard 26, is accomplished, in the exemplary embodiment, through a first pawl 90 pivotally engaged within the housing 22 and configured for selectively indexing into one of at least two guard notches 92 and 94 located along a top edge 96 of the first guard 26. This enables the first guard 26 to be retained in each of the extended guard position and retracted guard position, respectively, requiring the first pawl 90 to be disengaged from the respective guard notch 92 or 94 before the first guard 26 can be moved, so as to substantially prevent the first guard 26 from unintentionally changing position during use of the device 20. The first guard carrier 84, and thus the first guard 26, is engaged with a guard spring 98 positioned within the housing 22 and configured for biasing the first guard 26 outwardly, thereby urging the first guard 26 into the extended guard position. Additionally, the first pawl 90 is spring biased downwardly toward the guard notches 92 and 94. As shown in FIG. 2, the first guard notch 92 is positioned such that, when the first pawl 90 is engaged therewith, the first guard 26 is retained in the retracted guard position. Similarly, as shown in FIG. 3, the second guard notch 94 is positioned such that, when the first pawl 90 is engaged therewith, the first guard 26 is retained in the extended guard position. It should be noted that, in further embodiments, the first guard 26 may provide more than two guard notches, the additional guard notches being associated with varying distances by which the first guard 26 may extend. An outer surface 100 of the housing 22 further provides a pawl button 102 configured for being depressed and selectively actuating the first pawl 90, thereby temporarily disengaging it from the current guard notch 92 or 94. Because the first guard 26 is biased outwardly, when the pawl button 102 is depressed and the first pawl 90 is disengaged from the first guard notch 92, the first guard 26 automatically moves toward the extended guard position. When the pawl button 90 is subsequently released, the first pawl 90 then engages with the second guard notch 94. Similarly, to move the first guard 26 back into the retracted guard position, with the pawl button 102 depressed and the first pawl 90 disengaged from the second guard notch 94, a sufficient amount of inwardly directed force is applied to leading edge 34 of the first guard 26 to move the first guard 26 back into the housing 22, and the pawl button 102 is subsequently released, allowing the first pawl 90 to engage with first guard notch 92.

It should be noted that the above described configuration of the first guard 26 and the components which enable it to move between the extended and retracted guard positions is meant to simply illustrate one particular embodiment of the means for accomplishing such functionality. As such, the present invention should not be read as being so limited; but rather, any other configuration of components, now known or later developed, capable of substantially carrying out this functionality, may be substituted. For example, in a further embodiment, not shown, the first guard 26 may be manually moved between each of the extended guard position and retracted guard position.

Figure 7A:
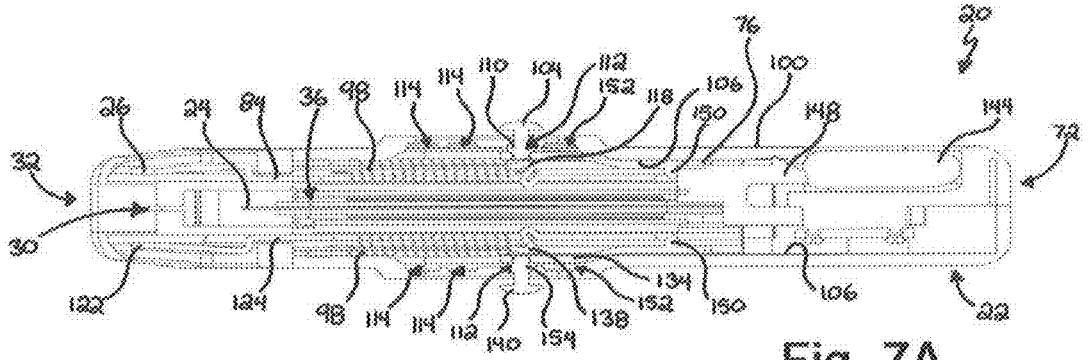
FIGS. 7A, 7B, and 7C are cross-sectional views taken along line 7-7 of FIG. 2.
Figure 7B:
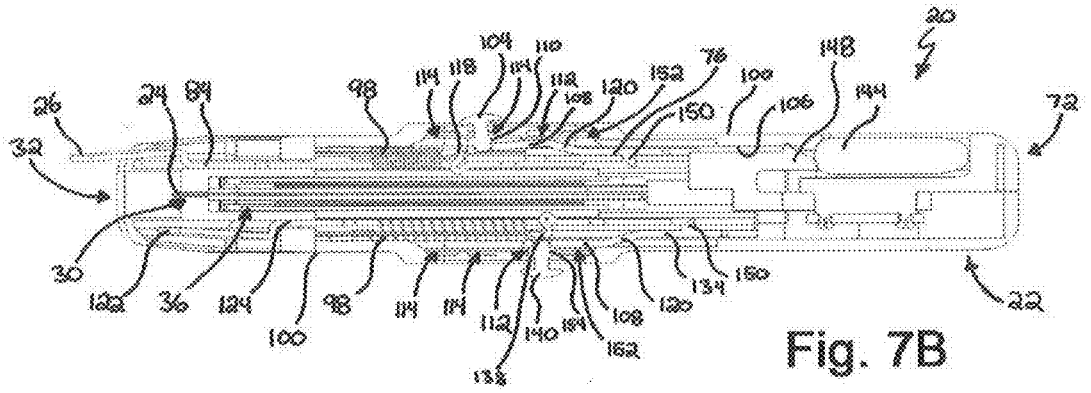

With reference to FIGS. 7A and 7B, longitudinal movement of the first blade actuating means 76, and thus the blade 24, is accomplished, in the exemplary embodiment, through a first blade button 104 interconnected with the first blade actuating means 76 and slidably positioned on the outer surface 100 of the housing 22. The first blade button 104 is preferably biased outwardly, toward an inner surface 106 of the housing 22—by virtue of a spring tab 108 or similar mechanism—and provides a button flange 110 positioned within the housing 22 and configured for selectively indexing into one of at least a home button recess 112, associated with the retracted blade position, and an extended button recess 114, associated with the extended blade position, each located on the inner surface 106 of the housing 22. In the exemplary embodiment, the inner surface 106 provides a further extended button recess 114, thereby allowing the blade 24 to selectively extend varying distances, for varying cutting depths during use. In further embodiments, the inner surface 106 may provide any number of extended button recesses 114 for allowing the blade 24 to selectively extend varying distances. It should be noted that the above described configuration of the first blade button 104 is meant to simply illustrate one particular embodiment of the means for moving the first blade actuating means 76, and thus the blade 24, between the extended and retracted blade positions. As such, the present invention should not be read as being so limited; but rather, any other configuration of components, now known or later developed, capable of substantially carrying out this functionality, may be substituted. As mentioned above, because the blade carrier 36, and thus the blade 24, is biased toward the retracted blade position in the exemplary embodiment, once the first blade button 104 is depressed, while the blade 24 is in the extended blade position, the blade 24 is automatically urged back into the retracted blade position, absent any contrary force by the user. As shown best in FIG. 1, in the exemplary embodiment, the outer surface 100 of the housing 22 provides button position indicia 116, adjacent the first blade button 104, configured for indicating the respective locations of the button recesses 112 and 114 on the inner surface 106 of the housing 22, as well as the current position of the first blade actuating means 76.

As mentioned above, in the exemplary embodiment, the device 20 provides a means for preventing the blade 24 from moving toward the extended blade position when the first guard 26 is in the retracted guard position, thereby rendering the blade 24 incapable of moving toward the extended blade position without first moving the first guard 26 toward the extended guard position. In the exemplary embodiment, as best shown in FIGS. 7A and 7B, this functionality is achieved by virtue of the first guard carrier 84 providing an interference tab 118 positioned in the actuating path of the first blade button 104, when the blade 24 is in the retracted blade position, such that the interference tab 118 selectively contacts and impedes the laterally inward movement of the first blade button 104. In other words, the interference tab 118 prevents the first blade button 104 from being depressed when the first guard 26 is in the retracted guard position. As such, again, the first guard 26, and thus the interference tab 118, must first be moved toward the extended guard position before the blade 24 is able to be moved toward the extended blade position. Thus, the leading point 28 of the blade 24 is never capable of extending past the leading edge 34 of the first guard 26, except when the first guard 26 is selectively momentarily retracted, as discussed below. Furthermore, the dimensions and configurations of these components are such that, the distance by which the leading edge 34 of the first guard 26 may extend past the first end 32 of the housing 22, when not in the retracted guard position, is greater than the distance by which the leading point 28 of the blade 24 may extend past the first end 32, when not in the retracted blade position. Thus, again, the leading point 28 of the blade 24 is never capable of extending past the leading edge 34 of the first guard 26, except when the first guard 26 is selectively momentarily retracted, as discussed below. It should be noted that the above described configuration of components is meant to simply illustrate one particular embodiment of the means for preventing the blade 24 from moving toward the extended blade position when the first guard 26 is in the retracted guard position. As such, the present invention should not be read as being so limited; but rather, any other configuration of components, now known or later developed, capable of substantially carrying out this functionality, may be substituted.

For example, in an alternate embodiment, not shown, this functionality is achieved by virtue of the first guard carrier 84 and first blade actuating means 76 being slidably positioned on the same surface of the first guide track 74, with the first guard carrier 84 positioned directly in front of the first blade actuating means 76 such that the first guard carrier 84 selectively contacts and impedes the movement of the first blade actuating means 76. In this way, the first blade actuating means 76, and thus the blade 24, is substantially prevented from traversing in a forward direction without first moving the first guard carrier 84 in the forward direction. Thus, the blade 24 is only capable of extending a distance no greater than the distance by which the first guard 26 has been extended.

As mentioned above, in the exemplary embodiment, the first guard 26, when in the extended guard position, is capable of selectively momentarily retracting when force is applied to the leading edge 34 of the first guard 26 in order to make a tray cut in a box, for example. In the exemplary embodiment, this functionality is accomplished by virtue of the first pawl 90 and the fact that the first guard 26 is biased outwardly toward the extended guard position. More specifically, when the first guard 26 is in the extended guard position and the blade 24 is in the extended blade position (FIG. 3), the pawl button 102 may be selectively depressed which, in turn, causes the first pawl 90 to disengage from the second guard notch 94, as discussed above. Thus, while the pawl button 102 is depressed, the first guard 26 is capable of selectively longitudinally retracting as a sufficient amount of force is applied to the leading edge 34 of the first guard 26; potentially even temporarily exposing the leading edge 34 of the blade 24. Because the first guard 26 is biased toward the extended guard position, as the blade 24 is removed from the object being cut (i.e., as the force being applied to the leading edge 34 of the first guard 26 is removed), the first guard 26 automatically moves back toward the extended position so as to shield the blade 24 once more. Once the pawl button 102 is no longer depressed, the first pawl 90 then re-engages with the second guard notch 94, once again locking the first guard 26 in the extended guard position. To better assist the user in accessing this functionality, so that the user may make a tray cut in a box, for example, the pawl button 102 is preferably positioned on the top surface 60 of the housing 22, proximal the first end 32 of the housing 22—essentially being located where the user's thumb would naturally be positioned when using the device 20 to make a tray cut. It should be noted that the above described configuration of the means for allowing the first guard 26 to selectively retract is meant to simply illustrate one particular embodiment of such means. As such, the present invention should not be read as being so limited; but rather, any other configuration of components, now known or later developed, capable of substantially carrying out this functionality, may be substituted.

For example, in the alternate embodiment, not shown, where the first guard carrier 84 and first blade actuating means 76 are slidably positioned on the same surface of the first guide track 74, with the first guard carrier 84 positioned directly in front of the first blade actuating means 76, the means for allowing the first guard 26 to selectively retract comprises a substantially longitudinally oriented spring tab, integral with a base of the first blade button 104, and a corresponding tab slot provided by a trailing edge of the first guard 26. The spring tab is selectively movable between a laterally inwardly flexed position and a normal planar position. The spring tab is configured for abutting the trailing edge of the first guard 26 when in the planar position, and the tab slot is configured for selectively receiving the spring tab therewithin when the spring tab is in the flexed position. Thus, when the first guard 26 is in the extended position and the spring tab is in the planar position during use, the first guard 26 will be held in place, regardless of the amount of force applied to the leading edge 34. When the first blade button 104 is depressed and the spring tab moved into the flexed position, the first guard 26 is capable of selectively longitudinally retracting a distance no greater than the length of the tab slot, as a sufficient amount of force is applied to the leading edge 34. Additionally, because the first guard 26 is preferably biased outwardly toward the extended guard position, as the blade 24 is removed from the object being cut, the first guard 26 automatically moves back toward the extended position so as to shield the blade 24 once more.

Referring again to the exemplary embodiment shown in FIGS. 7A and 7B, because the first guard 26 is capable of the selectively momentarily retracting, as discussed above, the device 20 further provides a means for preventing the first guard 26 from completely moving into the retracted guard position while the blade 24 is in the extended blade position. More specifically, the first blade actuating means 76 provides an inwardly directed shoulder 120, or similar structure in further embodiments, positioned and configured for selectively contacting the first guard carrier 84 and impeding the longitudinally inward movement of the first guard 26 toward the retracted guard position when the blade 24 is in the extended blade position. Thus, as the first guard 26 may selectively momentarily retract, as discussed above, the shoulder 120 of the first blade actuating means 76 physically prevents the first guard 26 from selectively longitudinally retracting any distance further than the point at which the shoulder 120 is located. Relatedly, should the first blade button 104 somehow overcome the prevention mechanism provided by the interference tab 118 while the blade 24 is in the retracted blade position and the first guard 26 is in the retracted guard position, as discussed above, such that the user is able to somehow move the blade 24 toward the extended blade position while the first guard 26 remains in the retracted guard position, the shoulder 120 would effectively prevent the blade 24 from actually reaching the extended blade position; such that the leading point 28 of the blade 24 would still not be able to extend past the leading edge 34 of the first guard 26. It should be noted that the above described configuration of the means for preventing the first guard 26 from completely moving into the retracted guard position while the blade 24 is in the extended blade position is meant to simply illustrate one particular embodiment of such means. As such, the present invention should not be read as being so limited; but rather, any other configuration of components, now known or later developed, capable of substantially carrying out this functionality, may be substituted.

Figure 7C:
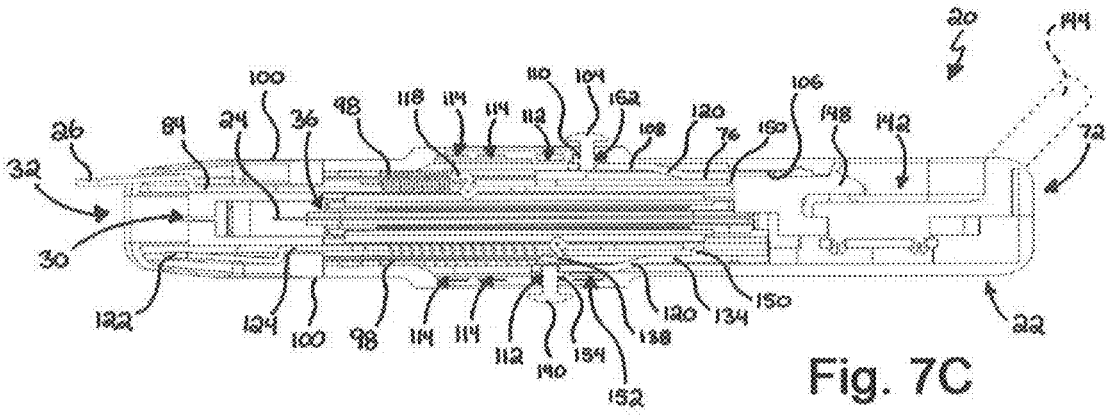
Figure 8:
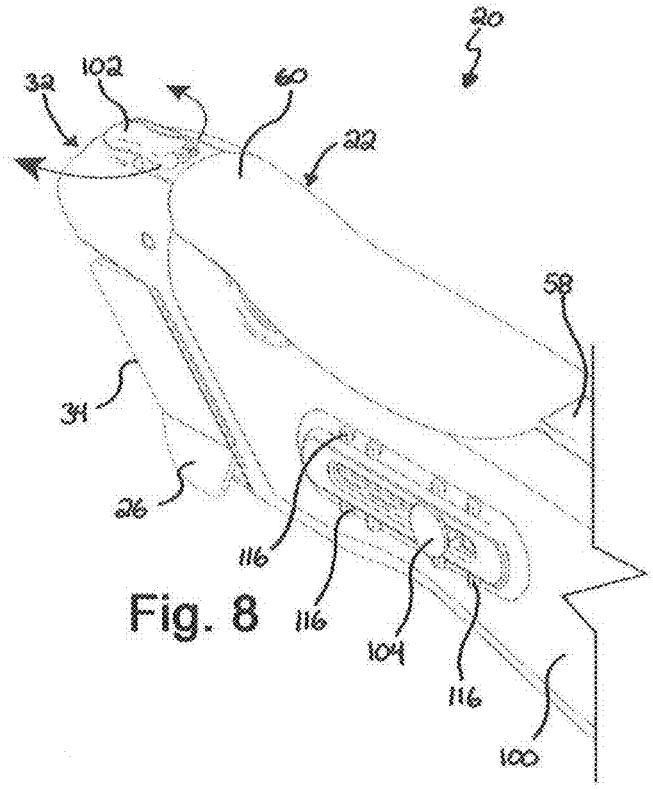
FIG. 8 is a partial perspective view of the exemplary safety cutting device.
Figure 9:
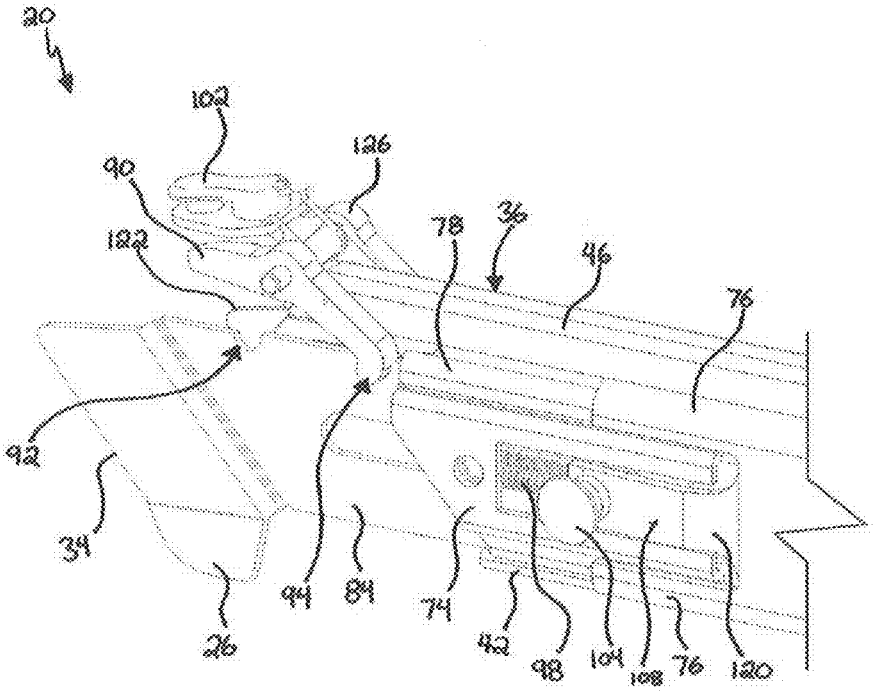
FIG. 9 is a further partial perspective view thereof, with the housing of the device removed for clarity purposes.

While the preceding discussion has described the device 20 in the context of having only a single first guard 26 positioned substantially adjacent the blade 24, which is certainly true in at least one embodiment, in the exemplary embodiment, the device 20 also provides a longitudinally movable second guard 122 oppo singly positioned substantially adjacent the blade 24, such that the first and second guards 26 and 122 flank the blade 24, as best shown in FIGS. 7A-7C. Additionally, the configuration of the second guard 122 and associated components (i.e., second guard carrier 124 and second pawl 126) are identical to, and positioned on the opposite side of the housing 22 from, the first guard 26 and associated components. More specifically, similar to the first guard carrier 84, the second guard carrier 124 is slidably positioned within an inner track 128 on a inner surface 130 of a longitudinally oriented second guide track 132 in the housing 22; the second guide track 132 being substantially adjacent to and parallel with the blade track 38, opposite the first guide track 74, such that the first and second guide tracks 74 and 132 flank the blade track 38. The second guard carrier 124 is engaged, or integral, with the second guard 122 for selectively moving the second guard 122 between the extended guard position and retracted guard position as the second guard carrier 124 traverses along the second guide track 132. Additionally, longitudinal movement of the second guard carrier 124, and thus the second guard 122, is accomplished, in the exemplary embodiment, through the second pawl 126, which is positioned and configured for operating on the second guard 122 in the same way that first pawl 90 operates on the first guard 26, as discussed above. In a bit more detail, as shown best in FIGS. 8 and 9, the pawl button 102 is positioned on the top surface 60 of the housing 22, substantially between the first and second pawls 90 and 126, and is configured for selectively pivoting between one of a first position, wherein the pawl button 102 is positioned over the first pawl 90 for selectively actuating the first pawl 90 (and, thus, the first guard 26), a second position, wherein the pawl button 102 is positioned over the second pawl 126, for selectively actuating the second pawl 126 (and, thus, the second guard 122), and a neutral position, wherein the pawl button 102 is positioned between the first and second pawls 90 and 126 and is thus incapable of actuating either of the pawls 90 or 126. Thus, each of the first and second guards 26 and 122 are operable independent of one another, to permit the user to expose one or the other side of the blade 24, depending on whether the user is holding the device 20 with their right or left hand.

In addition to the ambidextrous nature of the first and second guards 26 and 122 in the exemplary embodiment, the device 20 also preferably provides a second blade actuating means 134 slidably positioned on an outer surface 136 of the second guide track 132, such that the first and second blade actuating means 76 and 134 flank the blade carrier 36. Like the first blade actuating means 76, the second blade actuating means 134 is configured for selectively contacting and moving the blade carrier 36 therewith along the blade track 38, thus actuating the blade 24 between the extended blade position and retracted blade position. This actuation of the blade 24 is accomplished independent of the other blade actuating means 76 or 134. In other words, the blade 24 may be moved between the extended blade position and retracted blade position using either the first or second blade actuating means 76 or 134. Additionally, similar to the first blade actuating means 76, the second blade actuating means 134 is substantially prevented, by an interference tab 138 on the second guard carrier 124, from moving the blade 24 toward the extended blade position without first moving the second guard 122 into the extended guard position. In this way, the blade 24 is substantially prevented from moving toward the extended blade position without at least one of the first and second guards 26 and 122 first being moved out of the retracted guard position.

Similar to the second pawl 126, in the exemplary embodiment, the device 20 also preferably provides a second blade button 140 interconnected with the second blade actuating means 134 and slidably positioned on the outer surface 100 of the housing 22, opposite the first blade button 104.

Thus, this second set of mirrored components provides all of the same functionality as the first set of components, allowing both right- and left-handed users to operate the device 20 without having to change any settings or reconfigure the orientation of the guards 26 and 122 or blade 24. In use, when the user makes a right-handed cut, the user first extends the first guard 26 by depressing the pawl button 102 while in the first position. Once the first guard 26 is in the extended guard position, the user then extends the blade 24 using the first blade button 104. If the user needs the first guard 26 to selectively momentarily retract, in order to make a tray cut in a box, for example, the user then depresses the pawl button 102 while making such a cut. Once the cut has been made, the user may move the blade 24 back to the retracted blade position, again using the first blade button 104, and then move the first guard 26 back to the retracted guard position, by depressing the pawl button 102 once again and releasing once the first guard 26 has been pushed back into the retracted guard position. Similarly, when the user makes a left-handed cut, the user extends the second guard 122 by depressing the pawl button 102 while in the second position, then extends the blade 24 using the second blade button 140. If the user needs the second guard 122 to selectively momentarily retract, the user then depresses the pawl button 102 while making such a cut. Once the cut has been made, the user may move the blade 24 back to the retracted blade position, again using the second blade button 140, and then move the second guard 122 back to the retracted guard position, by depressing the pawl button 102 once again and releasing once the second guard 122 has been pushed back into the retracted guard position.

Figure 10:
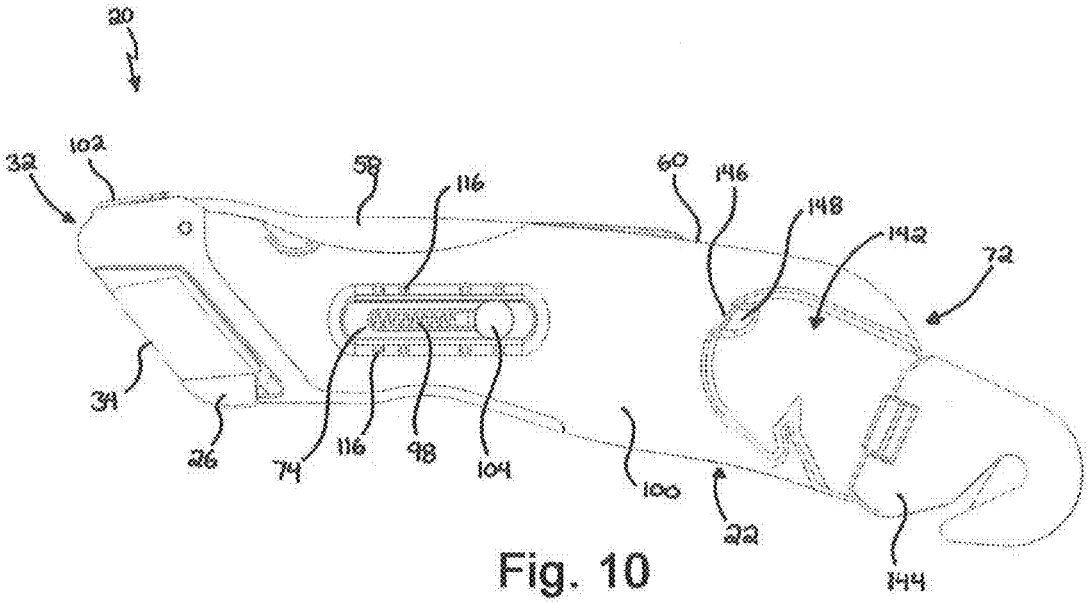
FIG. 10 is a side view of the exemplary safety cutting device, with a film cutter of the exemplary device in a deployed position.

Referring now to FIG. 10, in the exemplary embodiment, the second end 72 of the housing 22 further defines a film cutter indentation 142 sized and configured for selectively accepting a pivotally engaged film cutter 144 therewithin. The film cutter 144 is configured for selectively laterally pivoting between one of a stored position (FIG. 1), wherein the film cutter 144 is retained within the film cutter indentation 142, and a deployed position (FIG. 10). When in the deployed position, the film cutter 144 is preferably frictionally or otherwise held in place, by way of further indentations in the housing 22, so as to provide further stability to the film cutter 144 and to better ensure that the film cutter 144 does not unintentionally move out of the deployed position during use. Similarly, when in the stored position, the film cutter 144 is preferably frictionally retained within the film cutter indentation 142. Additionally, in the exemplary embodiment, the film cutter indentation 142 provides a retention lip 146 positioned and configured for further assisting in the retention of the film cutter 144 within the film cutter indentation 142.

As best shown in FIGS. 7A and 7C, in the exemplary embodiment, selective deployment of the film cutter 144 is achieved by way of a longitudinally oriented actuating wedge 148 slidably positioned within the housing 22 in a position substantially behind the first and second blade actuating means 76 and 134. In a bit more detail, the actuating wedge 148 is configured for slidably moving between one of a retracted wedge position (FIG. 7A), wherein the actuating wedge 148 is positioned substantially within the housing 22, and an extended wedge position (FIG. 7C), wherein the actuating wedge 148 extends a distance into the film cutter indentation 142. As illustrated in FIG. 7C, as the actuating wedge 148 moves into the extended wedge position, the actuating wedge 148 causes the film cutter 144 to pop out of the film cutter indentation 142, allowing the film cutter 144 to then be manually moved into the deployed position. In further embodiments, the film cutter 144 may be spring biased toward the deployed position.

With continued reference to FIGS. 7A and 7C, in the exemplary embodiment, longitudinal movement of the actuating wedge 148 is achieved through at least one of the first and second blade actuating means 76 and 134. Specifically, each of the first and second blade actuating means 76 and 134 provides a wedge tab 150 positioned and configured for selectively contacting and pushing the actuating wedge 148 into the extended wedge position, as the respective first or second blade actuating means 76 and 134 is slidably moved toward the second end 72 of the housing 22. Additionally, the inner surface 106 of the housing 22 provides further rear button recesses 152 positioned for enabling the respective button flange 110 and 154 of each of the first and second blade buttons 104 and 140 to selectively index therein, when the respective first or second blade actuating means 76 or 134 is moved toward the actuating wedge 148. It should be noted that, in some embodiments, only the first blade actuating means 76 is capable of selectively contacting the actuating wedge 148, while, in other embodiments, only the second blade actuating means 134 is capable of contacting the actuating wedge 148. In the exemplary embodiment, as the appropriate first or second blade button 104 or 140 is moved and indexed back into one of the home button recess 112 or extended button recess 114, and the film cutter 144 is manually rotated back into the stored position, the film cutter 144 simply pushes the actuating wedge 148 back into its retracted wedge position. However, in further embodiments, the actuating wedge 148 may be engaged, or somehow integral, with at least one of the first and second blade actuating means 76 and 134. In such further embodiments, the actuating wedge 148 is moved back into the retracted wedge position by simply moving the appropriate first or second blade actuating means 76 or 134 toward the first end 32 of the housing 22. It should be noted that the above described configuration of the film cutter 144 and the means for moving the film cutter 144 between its stored position and deployed position is meant to simply illustrate one particular embodiment of such a component and related means. As such, the present invention should not be read as being so limited; but rather, any other configuration of components, now known or later developed, capable of substantially carrying out this functionality, may be substituted. Furthermore, in still further embodiments, the device 20 may not provide any film cutter.

In still further embodiments, not shown, the device 20 also provides a locking means configured both for preventing the film cutter 144 from moving toward the deployed position while the blade 24 is not in the retracted blade position, and for preventing the blade 24 from moving toward the extended blade position while the film cutter 144 is not in the stored position. In this way, the device 20 prevents the film cutter 144 and blade 24 from ever being extended/deployed at the same time, thus further increasing the safety of the present invention in such embodiments. More specifically, the locking means preferably comprises a pivotally engaged locking piece positioned at least partially within the housing 22. A first end of the locking piece provides a locking tab configured for selective engagement with a corresponding locking slot in the film cutter 144, while an opposing second end of the locking piece provides a locking latch configured for selective engagement with a corresponding locking hook interconnected with at least one of the first and second blade actuating means 76 and 134 or blade carrier 36. The locking piece is configured for pivoting between one of a film lock position, wherein the locking tab engages the locking slot, thereby preventing the film cutter 144 from moving out of the stored position, a neutral position, wherein neither the locking tab is engaged with the locking slot nor the locking latch engaged with the locking hook, and a blade lock position, wherein the locking latch engages the locking hook, thereby preventing the blade 24 from moving into the extended blade position. Thus, when the blade 24 is moved toward the extended blade position, the locking piece is caused to move into the film lock position; when the film cutter 144 is moved toward the deployed position, the locking piece is caused to move into the blade lock position; and when both the blade 24 is in the retracted blade position and the film cutter 144 in the stored position, the locking piece is caused to move into the neutral position. It should be noted that the above described configuration of the locking means is meant to simply illustrate one particular embodiment of such means. As such, the present invention should not be read as being so limited; but rather, any other configuration of components, now known or later developed, capable of substantially carrying out this functionality, may be substituted.

In further embodiments, not shown, the device 20 may provide a tape cutter integral with the first end 32 of the housing 22; though, in other embodiments, the tape cutter may be integral with other portions of the housing 22.

To summarize, regarding the exemplary embodiments of the present invention as shown and described herein, it will be appreciated that a safety cutting device is disclosed and configured for strategically shielding a blade of the device so as to prevent or substantially reduce the risk of accidental injury to a user of the device. Because the principles of the invention may be practiced in a number of configurations beyond those shown and described, it is to be understood that the invention is not in any way limited by the exemplary embodiments, but is generally directed to a safety cutting device and is able to take numerous forms to do so without departing from the spirit and scope of the invention.

It should be noted that the various features of each of the above-described embodiments may be combined in any logical manner and are intended to be included within the scope of the present invention. It will also be appreciated by those skilled in the art that the present invention is not limited to the particular geometries and materials of construction disclosed, but may instead entail other functionally comparable structure, now known or later developed, without departing from the spirit and scope of the invention. Furthermore, while aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventors believe that the claimed subject matter is the invention.

What is claimed is:

1. A cutting device comprising:

a housing;

a longitudinally movable blade positioned within the housing and configured for selectively moving between one of an extended blade position, wherein a leading point of the blade extends through a blade aperture in a first end of the housing, and a retracted blade position, wherein the entire blade is positioned within the housing;

a longitudinally movable guard positioned substantially adjacent the blade and configured for selectively moving between one of an extended guard position, wherein a leading edge of the guard extends a distance past the first end of the housing, and a retracted guard position, wherein the leading edge is positioned relatively closer to the first end; and a means for preventing the blade from moving toward the extended blade position when the guard is in the retracted guard position.

2. The cutting device of claim 1, further comprising a longitudinally movable blade carrier positioned within the housing and configured for selectively receiving and moving the blade between the extended blade position and refracted blade position.

3. The cutting device of claim 2, wherein the blade carrier is biased inwardly for urging the blade into the retracted blade position.

4. The cutting device of claim 2, wherein the means for preventing the blade from moving toward the extended blade position comprises:

a longitudinally movable blade actuating means positioned within the housing and configured for selectively contacting the blade carrier and moving the blade carrier, and thus the blade, between the extended blade position and retracted blade position; and a longitudinally movable guard carrier positioned within the housing and engaged with the guard for selectively moving the guard between the extended guard position and retracted guard position;

the guard carrier configured for selectively contacting and impeding the movement of the blade actuating means such that the blade is substantially prevented from moving toward the extended blade position when the guard is in the retracted guard position.

5. The cutting device of claim 4, wherein the blade actuating means provides a longitudinally movable blade button positioned on an outer surface of the housing and configured for selectively longitudinally moving the blade actuating means; and the guard carrier provides an interference tab positioned in the actuating path of the blade button, when the blade is in the refracted blade position, such that the interference tab selectively contacts and impedes the laterally inward movement of the blade button.

6. The cutting device of claim 2, wherein the blade carrier comprises a means for top-loading the blade into the blade carrier.

7. The cutting device of claim 6, wherein the means for top-loading the blade comprises:

a pair of vertically oriented carrier walls spaced apart and configured for removably receiving the blade therebetween;

a blade support rail positioned between the carrier walls and configured for supporting a portion of a cutting edge of the blade;

a primary blade door pivotally engaged with a top edge of each of the carrier walls and configured for moving between one of an open position, allowing access to the blade, and a closed position, wherein the primary blade door contacts a non-cutting edge of the blade, thereby maintaining the blade within the blade carrier; and a secondary blade door pivotally engaged with a top surface of the housing in a position substantially adjacent the primary blade door and configured for moving between one of an open position, allowing access to the primary blade door, and a closed position, obstructing access to the primary blade door.

8. The cutting device of claim 7, wherein an inner surface of the primary blade door is configured for complementing a keyed surface of the non-cutting edge of the blade, thereby assisting in maintaining the position of the blade during use.

9. The cutting device of claim 7, wherein the top edge of each of the carrier walls defines a blade access notch configured for allowing the blade to be safely pulled out of the blade carrier.

10. The cutting device of claim 7, wherein the blade carrier is configured for storing an at least one top-loaded replacement blade, the blade carrier further comprising:

an at least one vertically oriented blade storage wall adjacent to at least one of the vertically oriented carrier walls;

the space between each of the at least one blade storage wall and the respective adjacent carrier wall being configured for removably receiving at least one replacement blade therewithin.

11. The cutting device of claim 1, wherein the distance by which the leading edge of the guard may extend past the first end of the housing, when not in the retracted guard position, is greater than the distance by which the leading point of the blade may extend past the first end, when not in the retracted blade position.

12. The cutting device of claim 1, wherein guard is biased outwardly for urging the guard into the extended guard position.

13. The cutting device of claim 12, further comprising:

a pawl pivotally engaged within the housing and configured for selectively indexing into one of at least two guard notches located along a top edge of the first guard, the guard notches positioned and configured for retaining the guard in the extended guard position and retracted guard position, respectively, the pawl being biased toward the guard notches; and a pawl button positioned on an outer surface of the housing and configured for being depressed and selectively actuating the pawl, thereby temporarily disengaging it from the respective guard notch.

14. The cutting device of claim 1, wherein the guard, when in the extended guard position, is capable of selectively momentarily retracting.

15. The cutting device of claim 1, further comprising a means for preventing the guard from moving into the retracted guard position while the blade is in the extended blade position.

16. The cutting device of claim 1, further comprising:

a longitudinally movable second guard opposingly positioned substantially adjacent the blade, such that the guards flank the blade, the second guard configured for selectively moving between one of an extended guard position, wherein a leading edge of the second guard extends a distance past the first end of the housing, and a retracted guard position, wherein the leading edge is positioned relatively closer to the first end;

the means for preventing the blade from moving toward the extended blade position configured for preventing the blade from moving toward the extended blade position when both of the guards are in the retracted guard position.

17. The cutting device of claim 16, further comprising:

a first pawl pivotally engaged within the housing and configured for selectively indexing into one of at least two guard notches located along a top edge of the first guard;

a second pawl pivotally engaged within the housing, substantially adjacent the first pawl, and configured for selectively indexing into one of at least two guard notches located along a top edge of the second guard; and a pawl button positioned on an outer surface of the housing, substantially between the first and second pawls, and configured for selectively pivoting between one of a first position, wherein the pawl button is positioned over the first pawl for selectively actuating the first pawl, a second position, wherein the pawl button is positioned over the second pawl, for selectively actuating the second pawl, and a neutral position, wherein the pawl button is positioned between the first and second pawls and is thus incapable of actuating either of the pawl;

wherein, the guard notches are positioned and configured for retaining the respective guard in the extended guard position and retracted guard position, respectively, the pawls are biased downwardly toward the respective guard notches, and each of the guards is biased outwardly for urging the guards into the extended guard position.

18. The cutting device of claim 1, wherein an opposing second end of the housing provides a pivotally engaged film cutter configured for selectively laterally pivoting between one of a stored position, wherein the film cutter is retained within a film cutter indentation formed in the second end of the housing, and a deployed position.

19. A cutting device comprising:

a housing;

a longitudinally movable blade positioned within the housing and configured for selectively moving between one of an extended blade position, wherein a leading point of the blade extends through a blade aperture in a first end of the housing, and a retracted blade position, wherein the entire blade is positioned within the housing;

a longitudinally movable blade carrier positioned within the housing and configured for selectively receiving and moving the blade between the extended blade position and retracted blade position;

a pair of longitudinally movable blade actuating means positioned within the housing, flanking the blade carrier, each of the blade actuating means configured for independently selectively contacting and moving the blade carrier therewith;

a pair of longitudinally movable guards flanking the blade, each of the guards configured for independently selectively moving between one of an extended guard position, wherein a leading edge of the guard extends a distance past the first end of the housing, and a retracted guard position, wherein the leading edge is positioned relatively closer to the first end; and a means for preventing the blade from moving toward the extended blade position when both of the guards are in the retracted guard position, such that the blade is substantially prevented from moving toward the extended blade position without at least one of the guards first being moved out of the retracted guard position;

whereby, the distance by which the leading edge of either guard may extend past the first end of the housing, when not in the retracted guard position, is greater than the distance by which the leading point of the blade may extend past the first end, when not in the retracted blade position.

* * * * *